US010875675B2

(12) United States Patent
Benedetti et al.

(10) Patent No.: US 10,875,675 B2
(45) Date of Patent: Dec. 29, 2020

(54) PACKAGING APPARATUS FOR FORMING SEALED PACKAGES

(71) Applicant: TETRA LAVAL HOLDINGS & FINANCE S.A., Pully (CH)

(72) Inventors: Paolo Benedetti; Filippo Ferrarini, Modena (IT); Nicola Garuti, Reggio Emilia (IT); Paolo Sanibondi, Reggio Emilia (IT); Yutaka Kaneko, Chiba (JP)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 16/646,934

(22) PCT Filed: Sep. 11, 2018

(86) PCT No.: PCT/EP2018/074419
§ 371 (c)(1),
(2) Date: Mar. 12, 2020

(87) PCT Pub. No.: WO2019/052992
PCT Pub. Date: Mar. 21, 2019

(65) Prior Publication Data

US 2020/0277096 A1 Sep. 3, 2020

(30) Foreign Application Priority Data

Sep. 13, 2017 (EP) ..... 17190751

(51) Int. Cl.
*B65B 55/02* (2006.01)
*B65B 55/10* (2006.01)
(Continued)

(52) U.S. Cl.
CPC ..... *B65B 55/04* (2013.01); *B65B 9/08* (2013.01); *B65B 9/12* (2013.01); *B65B 9/2028* (2013.01);
(Continued)

(58) Field of Classification Search
CPC ..... B65B 55/04; B65B 55/00; B65B 55/02; B65B 55/027; B65B 55/10
(Continued)

(56) References Cited

U.S. PATENT DOCUMENTS 3,854,874 A * 12/1974 Loliger ..... B65B 55/103 422/299
4,656,813 A * 4/1987 Baldini ..... B65B 55/02 53/410
(Continued)

FOREIGN PATENT DOCUMENTS

EP 2343242 A1 7/2011
GB 947256 A 1/1964
(Continued)

OTHER PUBLICATIONS

International Search Report and Written Opinion issued in corresponding International Patent Application No. PCT/EP2018/074419, 11 pages (dated Jan. 22, 2019).

*Primary Examiner* — Gloria R Weeks
(74) *Attorney, Agent, or Firm* — Buchanan Ingersoll & Rooney PC

(57) ABSTRACT

There is described a packaging apparatus for forming a plurality of sealed packages from a tube of a web of packaging material which is continuously filled with a pourable product. The packaging apparatus comprises a delimiting element arranged, in use, within the tube and being designed to divide the tube, in use, in a first space and a second space. The packaging apparatus also comprises a
(Continued)

pressurizing device for pressurizing the second space by a sterile gas withdrawn from the inner environment of an isolation chamber within which the tube is formed. Furthermore, the delimiting element is also designed to allow, in use, a leakage flow of sterile gas from the second space into the first space.

17 Claims, 3 Drawing Sheets

(51) Int. Cl.

| | |
|---|---|
| ***B65B 55/04*** | (2006.01) |
| ***B65B 9/08*** | (2012.01) |
| ***B65B 9/12*** | (2006.01) |
| ***B65B 9/20*** | (2012.01) |
| ***B65B 51/26*** | (2006.01) |
| ***B65B 31/02*** | (2006.01) |
| ***B65B 31/04*** | (2006.01) |
| ***B65B 41/16*** | (2006.01) |

(52) U.S. Cl.
CPC ..... *B65B 9/2049* (2013.01); *B65B 31/02* (2013.01); *B65B 31/045* (2013.01); *B65B 41/16* (2013.01); *B65B 51/26* (2013.01)

(58) Field of Classification Search
USPC ..... 53/510, 511, 551
See application file for complete search history.

(56) References Cited

U.S. PATENT DOCUMENTS

| | | | | |
|---|---|---|---|---|
| 4,809,485 | A * | 3/1989 | Nielsen | B65B 39/00 53/503 |
| 4,958,665 | A * | 9/1990 | Iwano | B65B 3/30 141/95 |
| 5,044,140 | A * | 9/1991 | Iwano | B65B 55/027 134/169 C |
| 6,230,472 | B1 * | 5/2001 | Stahlecker | A61L 2/14 53/331.5 |
| 6,397,557 | B1 * | 6/2002 | Bassissi | B29C 53/54 53/51 |
| 6,510,669 | B1 * | 1/2003 | Bellei | B65B 55/103 493/213 |
| 8,938,938 | B2 * | 1/2015 | Konno | B29C 66/8491 53/551 |
| 8,943,786 | B2 * | 2/2015 | Konno | B65B 9/20 53/503 |
| 9,238,515 | B2 * | 1/2016 | Persson | B65B 9/20 |
| 2009/0223173 | A1 * | 9/2009 | Rapparini | B65B 9/06 53/425 |
| 2009/0282784 | A1 * | 11/2009 | Ferrarini | B65B 1/02 53/426 |

FOREIGN PATENT DOCUMENTS

| | | | |
|---|---|---|---|
| WO | 2009139129 | A1 | 11/2009 |
| WO | 2011075055 | A1 | 6/2011 |
| WO | 2014195112 | A1 | 12/2014 |

* cited by examiner

PACKAGING APPARATUS FOR FORMING SEALED PACKAGES

TECHNICAL FIELD

The present invention relates to a packaging apparatus for forming sealed packages, in particular for forming sealed packages filled with a pourable product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material.

The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging apparatus, which advance a web of packaging material through a sterilization unit of the packaging apparatus for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber (a closed and sterile environment), and is folded and sealed longitudinally to form a tube, which is further fed along a vertical advancing direction.

In order to complete the forming operations, the tube is continuously filled with a sterilized or sterile-processed pourable food product, and is transversally sealed and subsequently cut along equally spaced transversal cross sections within a package forming unit of the packaging apparatus during advancement along the vertical advancing direction.

Pillow packages are so obtained within the packaging apparatus, each pillow package having a longitudinal sealing band and a pair of top and bottom transversal sealing bands.

Furthermore, a typical packaging apparatus comprises a conveying device for advancing a web of packaging material along an advancement path, a sterilizing unit for sterilizing the web of packaging material, a tube forming device arranged within an isolation chamber and being adapted to form the tube from the advancing web of packaging material, a sealing device for longitudinally sealing the tube along a seam portion of the tube, a filling pipe, in use, being coaxially arranged to and within the tube for continuously filling the tube with the pourable product and a package forming unit adapted to produce the single packages from the tube of packaging material by shaping, transversally sealing and transversally cutting the packages.

The package forming unit comprises a plurality of forming, sealing and cutting assemblies, each one, in use, advancing along a respective operative path parallel to the advancement path of the tube. During advancement of the forming, sealing and cutting assemblies these start to interact with the tube at a hit position and follow the advancing tube so as to shape, to transversally seal and to transversally cut the tube so as to obtain the single packages.

In order to correctly form the single packages, it is required that the hydrostatic pressure provided by the pourable product within the tube is sufficiently high as otherwise irregularly shaped packages would be obtained.

Typically, the pourable product column present in the tube for providing for the required hydrostatic pressure extends at least 500 mm upwards from the hit position (i.e. the position at which the respective forming, sealing and cutting assemblies start to contact the advancing tube). In some cases, the pourable product column extends up to 2000 mm upwards from the hit position. It is known in the art that the exact extension depends at least on the package format and the production speeds.

In practice, this means that the tube must have an extension so as to provide for the required pourable product column within the tube.

Therefore, the vertical extension of the isolation chamber of the packaging apparatus must be rather elevated in order to provide the needed level of pourable product within the tube.

The required hydrostatic pressure is dependent on production parameters, such as the advancement speed of the web of packaging material and, accordingly, of the advancement speed of the tube (in other words, it is dependent on the processing speed of the packaging apparatus), on the package format and the package volume. This means, that if any production parameter is to be varied, it is necessary that one or more operators modify the packaging apparatus accordingly. The needed modifications are lengthy in time and, thus, lead to increasing production costs.

WO-A-2011075055 discloses a packaging apparatus for filling a tube of packaging material. The packaging apparatus comprises a gas feeding pipe and a product filling pipe is coaxially arranged within the gas feeding pipe. As a consequence, an annular slit is provided between the outer surface of the product filling pipe and the inner surface of the gas feeding pipe. The annular slit is designed to introduce compressed air into a first space of the tube. The packaging apparatus also comprises a gasket coupled to the gas feeding pipe. The gasket divides the tube formed from the web of packaging material and to be filled with the pourable product into the first space and a second space. In use, the gasket is in contact with the inner surface of the tube for sealing the first space and the second space.

A need is felt for an improved such packaging apparatus.

DISCLOSURE OF INVENTION

It is therefore an object of the present invention to provide in a straightforward and low-cost manner an improved packaging apparatus.

According to the present invention, there is provided a packaging apparatus as claimed in claim 1.

Further advantageous embodiments of the packaging apparatus according to the invention are specified in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
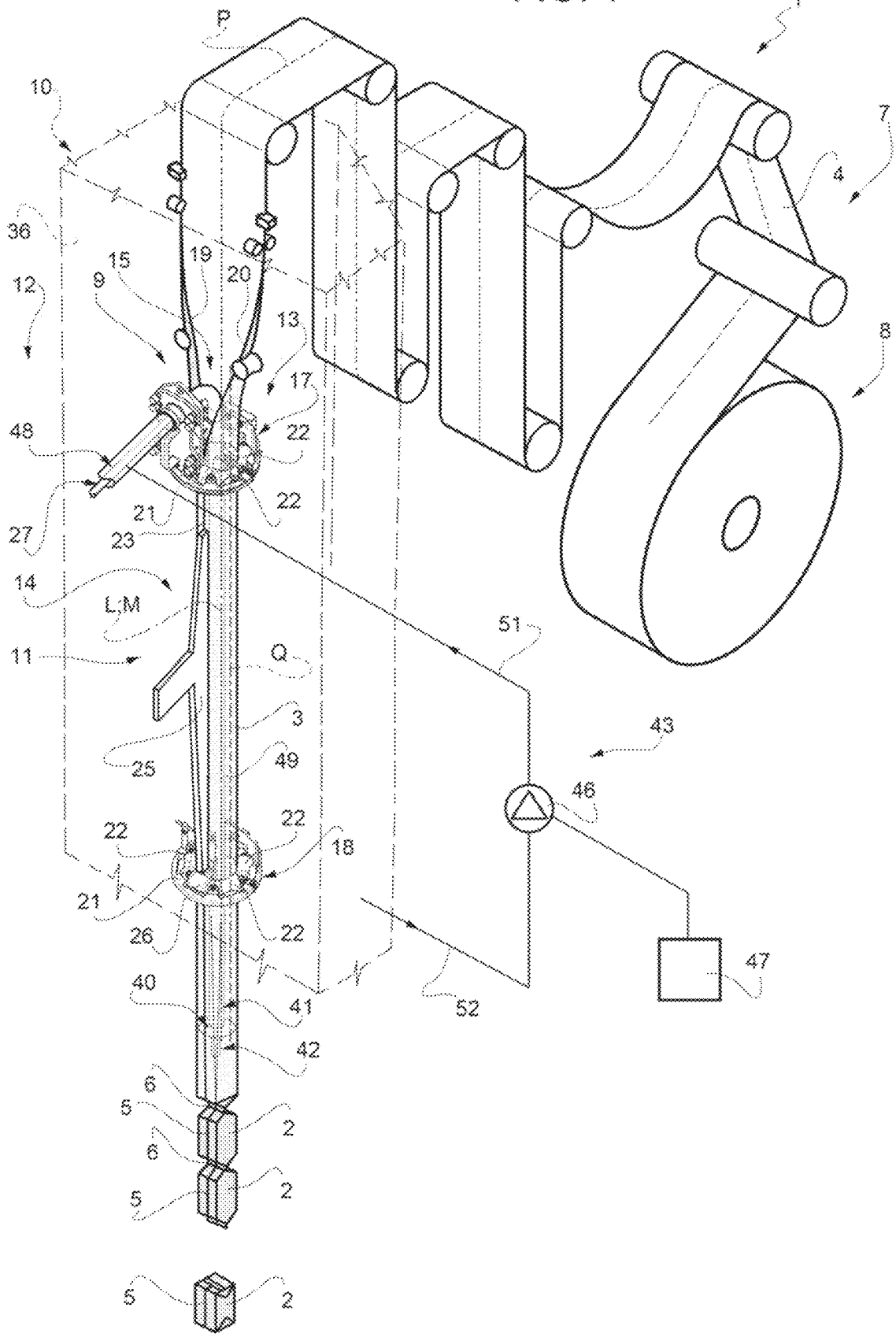
FIG. 1 is a schematic view of a packaging apparatus according to the present invention, with parts removed for clarity.

Number 1 indicates as a whole a packaging apparatus for producing sealed packages 2 of a pourable food product, such as pasteurized milk or fruit juice, from a tube 3 of a web 4 of packaging material. In particular, in use, tube 3 extends along a longitudinal axis L, in particular, axis L having a vertical orientation.

Web 4 of packaging material has a multilayer structure (not shown), and comprises a layer of fibrous material, normally paper, covered on both sides with respective layers of heat-seal plastic material, e.g. polyethylene.

Preferably, web 4 also comprises a layer of gas- and light-barrier material, e.g. aluminum foil or ethylene vinyl alcohol (EVOH) film, and at least a first and a second layer of heat-seal plastic material. The layer of gas- and light-barrier material is superimposed on the first layer of heat-seal plastic material, and is in turn covered with the second layer of heat-seal plastic material. The second layer of heat-seal plastic material forms the inner face of package 2 eventually contacting the food product.

A typical package 2 obtained by packaging apparatus 1 comprises a sealed longitudinal seam portion 5 and a pair of transversal seal portions 6, in particular a pair of top and bottom transversal seal portions 6 (i.e. one seal portion 6 at an upper portion of package 2 and another seal portion 6 at a lower portion of package 2).

With particular reference to FIG. 1, packaging apparatus 1 comprises:

- conveying means 7 for advancing in a known manner web 4 along its longitudinal axis along a web advancement path P from a delivery station 8 to a forming station 9, at which, in use, web 4 is formed into tube 3;
- an isolation chamber 10 having an inner environment 11, in particular an inner sterile environment 11, containing a sterile gas, in particular sterile air, at a given gas pressure and being separated from an outer environment 12;
- a tube forming device 13 extending along a longitudinal axis M, in particular having a vertical orientation, and being arranged, in particular at forming station 9, at least partially, preferably fully, within isolation chamber 10 and being adapted to form tube 3 from the, in use, advancing web 4;
- a sealing device 14 at least partially arranged within isolation chamber 10 and being adapted to longitudinally seal tube 3 formed by tube forming device 13;
- filling means 15 for continuously filling tube 3 with the pourable product; and
- a package forming unit 16 adapted to shape, to transversally seal and to transversally cut the, in use, advancing tube 3 for forming packages 2.

Preferably, packaging apparatus 1 also comprises a sterilizing unit (not shown and known as such) adapted to sterilize the, in use, advancing web 4 at a sterilization station, in particular the sterilization station being arranged upstream of forming station 9 along path P.

Preferentially, conveying means 7 are adapted to advance tube 3 and any intermediate of tube 3 in a manner known as such along a tube advancement path Q, in particular from forming station 9 to package forming unit 16. In particular, with the wording intermediates of tube 3 any configuration of web 4 is meant prior to obtaining the tube structure and after folding of web 4 by tube forming device 13 has started. In other words, the intermediates of tube 3 are a result of the gradual folding of web 4 so as to obtain tube 3, in particular by overlapping with one another a first edge 19 of web 4 and a second edge 20 of web 4, opposite to first edge 19.

Preferentially, tube forming device 13 is adapted to gradually fold web 4 into tube 3, in particular by overlapping edges 19 and 20 with one another for forming a longitudinal seam portion 23 of tube 3, in particular the longitudinal seam portion 23 being, in use, sealed by activation of sealing device 14.

In particular seam portion 23 extends from an initial level (not specifically shown) into a downward direction along path Q. In other words, the initial level is at the position at which edges 19 and 20 start to overlap one another for forming seam portion 23.

In particular, at least a portion of path Q lies within isolation chamber 10 (in particular, within inner environment 11).

In more detail, tube forming device 13 defines, in use, axis L of tube 3, in particular axis L and axis M being parallel to one another.

Preferentially, tube forming device 13 comprises at least two forming ring assemblies 17 and 18, in particular arranged within isolation chamber 10 (in particular, within inner environment 11), being adapted to gradually fold in cooperation with one another web 4 into tube 3, in particular by overlapping edges 19 and 20 with one another for forming longitudinal seam portion 23.

In the specific case shown, forming ring assembly 18 is arranged downstream of forming ring assembly 17 along path Q.

In particular, each one of forming ring assemblies 17 and 18 substantially lie within a respective plane, in particular each plane being orthogonal to axis M, even more particular each respective plane having a substantially horizontal orientation.

Even more particular, forming ring assemblies 17 and 18 are spaced apart from and parallel to one another (i.e. the respective planes are parallel to and spaced apart from one another).

Preferentially, each plane is orthogonal to axis M and to axis L.

Furthermore, forming ring assemblies 17 and 18 are arranged coaxial to one another. In particular, forming ring assemblies 17 and 18 define longitudinal axis M of tube forming device 13.

More specifically, each forming ring assembly 17 and 18 comprises a respective support ring 21 and a plurality of respective bending rollers 22 mounted onto the respective support ring 21. In particular, the respective bending rollers 22 are configured to interact with web 4 and/or tube 3 and/or any intermediates of tube 3 for forming tube 3. Even more particular, the respective bending rollers 22 define respective apertures through which, in use, tube 3 and/or the intermediates of tube 3 advance.

In further detail, sealing device 14 is adapted to longitudinally seal tube 3 along seam portion 23.

It must be noted that the respective longitudinal sealed seam portion 5 of the single packages 2 result from cutting tube 3. In other words, the respective seam portions 5 of the single packages 2 are respective sections of seam portion 23 of tube 3.

Furthermore, sealing device 14 comprises a sealing head 25 adapted to interact with tube 3, in particular with seam portion 23 for longitudinally sealing tube 3, in particular seam portion 23. In particular, sealing head 25 is adapted to heat tube 3, in particular along seam portion 23. Sealing head 25 can be of any kind. In particular, sealing head 25 can be of the kind operating by means of induction heating or by a stream of heat or by means of ultrasound or other means.

Preferentially, sealing device 14 also comprises a pressuring assembly (only partially shown) adapted to exert a mechanical force on tube 3, in particular on the substantially overlapping edges 19 and 20, even more particular onto seam portion 23 of tube 3 so as to ensure sealing of tube 3 along seam portion 23.

In particular, the pressuring assembly comprises at least an interaction roller 26 and a counter-interaction roller (not shown) adapted to exert the mechanical force onto seam portion 23 from opposite sides thereof. In particular, in use, seam portion 23 is interposed between interaction roller 26 and the counter-interaction roller.

Preferentially, interaction roller 26 is supported by forming ring assembly 18.

In more detail, sealing head 25 is arranged substantially between ring forming assemblies 17 and 18 (i.e. sealing head 25 is arranged between the respective planes of ring forming assemblies 17 and 18).

Figure 2:
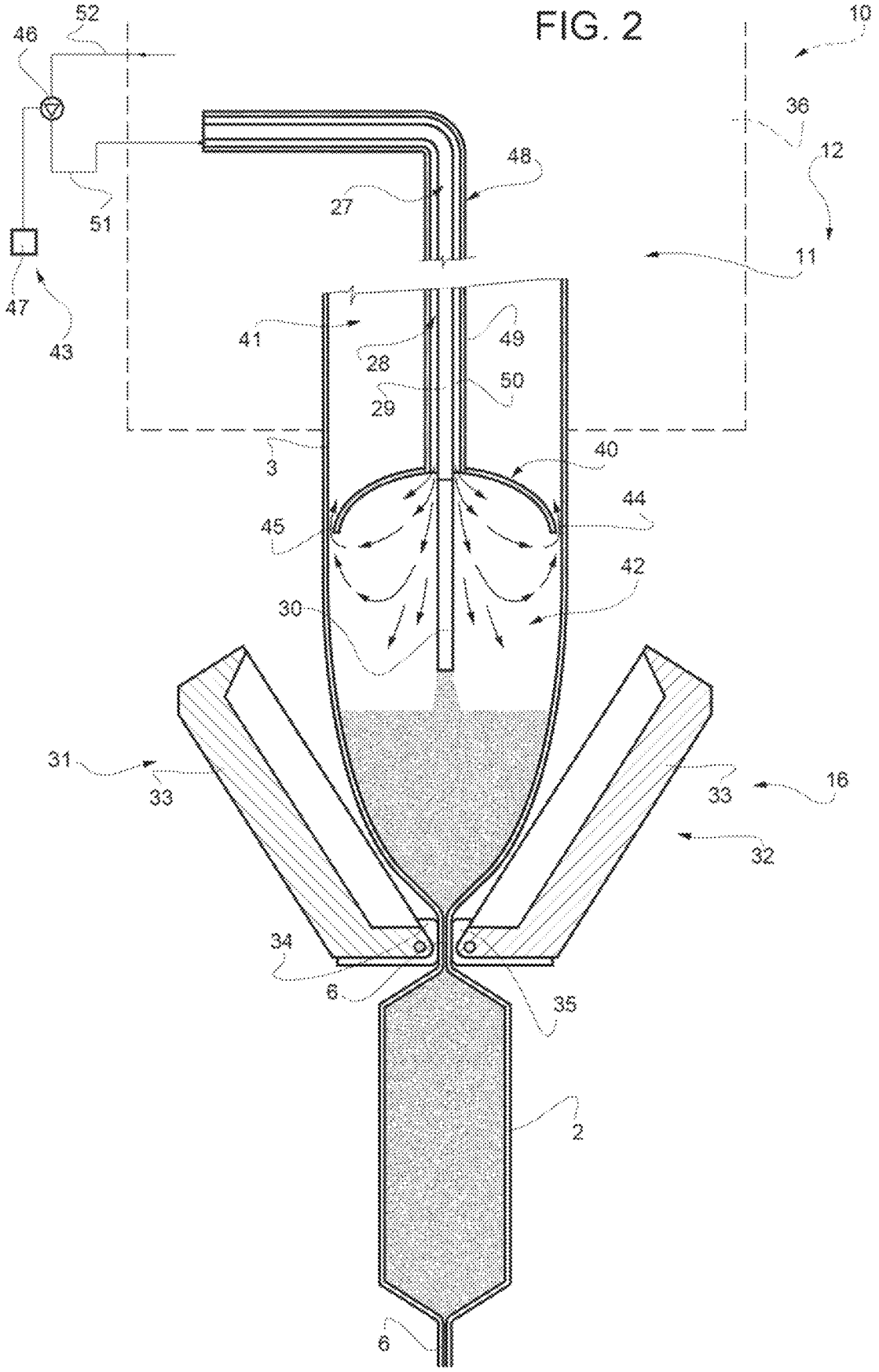
FIG. 2 is an enlarged view of a detail of the packaging apparatus of FIG. 1, with parts removed for clarity.

With particular reference to FIGS. 1 and 2, filling means 15 comprise a filling pipe 27 being in fluid connection with a pourable product storage tank (not shown and known as such), which is adapted to store/provide for the pourable product to be packaged.

In particular, filling pipe 27 is adapted to direct, in use, the pourable product into tube 3.

Preferentially, filling pipe 27 is, in use, at least partially placed within tube 3 for continuously feeding the pourable product into tube 3.

In particular, tube 13 has a L-shaped configuration arranged in such a manner that a linear main pipe portion 28 of filling pipe 27 extends within tube 3, in particular parallel to axis M and axis L.

Even more particular, main pipe portion 28 comprises an upper section 29 and a lower section 30 removably coupled to one another. In further detail, lower section 30 comprises an outlet opening from which the pourable product is fed, in use, into tube 3.

With reference to FIG. 2, package forming unit 16 comprises:

- a plurality of operative assemblies 31 (only one shown) and a plurality of counter-operative assemblies 32 (only one shown); and
- a conveying device (not shown and known as such) adapted to advance the operative assemblies 31 and the counter-operative assemblies 32 along respective conveying paths.

In more detail, each operative assembly 31 is adapted to cooperate, in use, with one respective counter-operative assembly 32 for forming a respective package 2 from tube 3. In particular, each operative assembly 31 and the respective counter-operative assembly 32 are adapted to shape, to transversally seal and, preferably also to transversally cut, tube 3 for forming packages 2.

In further detail, each operative assembly 31 and the respective counter-operative assembly 32 are adapted to cooperate with one another for forming a respective package 2 from tube 3 when advancing along a respective operative portion of the respective conveying path. In particular, during advancement along the respective operative portion each operative assembly 31 and the respective counter-operative assembly 32 advance parallel to and in the same direction as tube 3.

In more detail, each operative assembly 31 and the respective counter-operative assembly 32 are configured to contact tube 3 when advancing along the respective operative portion of the respective conveying path. In particular, each operative assembly 31 and the respective counter-operative assembly 32 are configured to start to contact tube 3 at a (fixed) hit position.

Preferentially, filling means 15 are configured to direct the pourable product into tube 3 such that the extension of the pourable product column present in tube 3 from the hit position in an upstream direction is less than 500 mm. Even more preferably, the extension of the pourable product column from the hit position in the upstream direction lies within a range of about 100 mm to 500 mm.

Furthermore, each operative assembly 31 and counter-operative assembly 32 comprises:

- a half-shell 33 adapted to contact tube 3 and to at least partially define the shape of packages 2;
- one of a sealing element 34 or a counter-sealing element 35, adapted to transversally seal tube 3 in a known manner between adjacent packages 2 for obtaining seal portions 6; and
- one of a cutting element (not shown and known as such) or a counter-cutting element (not shown and known as such) for transversally cutting tube 3 between adjacent packages 2, in particular between the respective seal portions 6, in a manner known as such.

In particular, each half-shell 33 is adapted to be controlled between a working position and a rest position by means of a driving assembly (not shown). In particular, each half-shell 33 is adapted to be controlled into the working position with the respective operative assembly 31 or the respective counter-operative assembly 32, in use, advancing along the respective operative portion.

With particular reference to FIGS. 1 and 2, isolation chamber 10 comprises a housing 36 (only schematically shown in FIGS. 1 and 2) delimiting the inner environment 11 (i.e. housing 36 separates inner environment 11 from outer environment 12). In particular, inner environment 11 comprises (i.e. contains) the sterile gas, in particular the sterile air, at a given pressure. Preferentially, the given pressure is slightly above ambient pressure for reducing the risk of any contaminants entering inner environment 11. In particular, the given pressure is about 100 Pa to 500 Pa (0.001 bar to 0.005 bar) above ambient pressure.

Preferentially, packaging apparatus 1 comprises means (not shown and known as such) for feeding the sterile gas, in particular the sterile air, into isolation chamber 10, in particular inner environment 11.

According to the present invention and with particular reference to FIG. 2, packaging apparatus 1 also comprises:

- a delimiting element 40 placed, in use, within tube 3 and designed to divide tube 3, in use, into a first space 41 and a second space 42; and
- pressurizing means 43 adapted to direct, in particular to continuously direct, in use, a flow of sterile gas into second space 42 for obtaining a gas pressure within second space 42 that is higher than the gas pressure within first space 41.

In more detail, first space 41 is delimited by tube 3, in particular the walls of tube 3, and delimiting element 40.

Furthermore, first space 41 opens up into inner environment 11. Even more particular, delimiting element 40 delimits first space 41 at a downstream portion, in particular a bottom portion, of first space 41 itself.

In more detail, second space 42 is delimited, in use, by tube 3, in particular the walls of tube 3, delimiting element 40 and seal portion 6.

In other words, second space 42 extends in a direction parallel to path Q (i.e. parallel to axis L) from delimiting element 40 to seal portion 6.

In even other words, delimiting element 40 delimits second space 42 at an upstream portion, in particular an upper portion, of second space 42 itself; and seal portion 6 delimits second space 42 at a downstream portion, in particular a bottom portion, of second space 42 itself.

In further detail, first space 41 is arranged upstream of second space 42 along tube advancement path Q. Even more particular, first space 41 is arranged upstream of delimiting element 40 along path Q and second space 42 is arranged downstream of delimiting element 40 along path Q. In the specific example shown, second space 42 is placed below first space 41.

In particular, as will become clear from the following description, second space 42 defines a high-pressure zone within tube 3 and first space 41 defines a low-pressure zone within tube 3.

In the context of the present application, high-pressure zone is to be understood such that the internal pressure lies in a range of about 5 kPa to 40 kPa (0.05 bar to 0.4 bar), in particular of about 10 kPa to 30 kPa (0.10 bar to 0.30 bar) above ambient pressure (i.e. the pressure within second space 42 lies in a range of about 5 kPa to 40 kPa (0.05 bar to 0.4 bar), in particular of about 10 kPa to 30 kPa (0.10 bar to 0.30 bar) above ambient pressure). In other words, second space 42 is overpressurized.

Low-pressure zone is to be understood such that the pressure is slightly higher than the ambient pressure. In particular, slightly higher than the ambient pressure means that the pressure lies in a range between 100 Pa to 500 Pa (0.001 bar to 0.005 bar) above ambient pressure.

In further detail, first space 41 is in (direct) fluidic connection with inner environment 11. Thus, sterile gas present in first space 41 can flow to inner environment 11.

In particular, tube 3 (and its intermediates) lie at least partially within isolation chamber 10 (in particular, within inner environment 11).

Preferentially, the pressure inside first space 41 (substantially) equals the given pressure present in isolation chamber 10, in particular in inner environment 11. In other words, preferentially, the pressure inside first space 41 ranges between 100 Pa to 500 Pa (0.001 bar to 0.005 bar) above ambient pressure.

More specifically, delimiting element 40 is arranged, in use, downstream of the above-mentioned initial level along path Q. In other words, delimiting element 40 is positioned below the point from which seam portion 23 extends along a downstream direction (with respect to path Q). In even other words, delimiting element 40 is arranged below the position from which edges 19 and 20 are superimposed for forming seam portion 23.

In further detail, second space 42 is delimited by delimiting element 40 and the respective seal portion 6, in particular the seal portion 6 being, in use, placed downstream from delimiting element 40 (with respect to path Q).

Furthermore, in use, filling means 15, in particular filling pipe 27, are adapted to direct the pourable product into second space 42. Thus, in use, second space contains the pourable product and the pressurized sterile gas. The pressurized sterile gas provides for the required hydrostatic force needed for a correct forming of packages 2 (i.e. in other words, the sterile gas replaces the effect of the pourable product column within tube 3).

Advantageously, delimiting element 40 is designed to provide, in use, for at least one fluidic channel 44, in particular having an annular shape, for fluidically connecting second space 42 with first space 41 allowing for, in use, a leakage flow of sterile gas from second space 42 into first space 41. In particular, in use, the sterile gas leaks from second space 42 (the high-pressure zone) to first space 41 (the low-pressure zone) through fluidic channel 44. By providing for fluidic channel 44 it is possible to control the gas pressure within second space 42 with an increased accuracy.

Preferentially, in use, delimiting element 40 is designed such that, in use, fluidic channel 44 is provided by a gap between the inner surface of tube 3 and delimiting element 40, in particular a peripheral portion 45 of delimiting element 40.

Preferably, delimiting element 40 is arranged such that, in use, delimiting element 40 faces the inner surface of tube 3 so that fluidic channel 44 is delimited by peripheral portion 45 and the inner surface of the, in use, advancing tube 3. In other words, in use, delimiting element 40 and the inner surface of tube 3 do not touch each other. Thus, no wear of delimiting element 40 occurs due to interaction between delimiting element 40 and tube 3. As well, delimiting element 40 does not damage, in use, the inner surface of tube 3.

In further detail, delimiting element 40 has a radial extension being smaller than the inner diameter of tube 3. Preferentially, in case of a format change leading to a change of the inner diameter of tube 3, delimiting element 40 can be replaced by a new delimiting element 40.

In the specific case shown, delimiting element 40 has a curved outer profile. Alternatively, other configurations of delimiting element 40 could be chosen, such as having a substantially straight shape or having a straight central portion and a curved peripheral portion.

Figure 3:
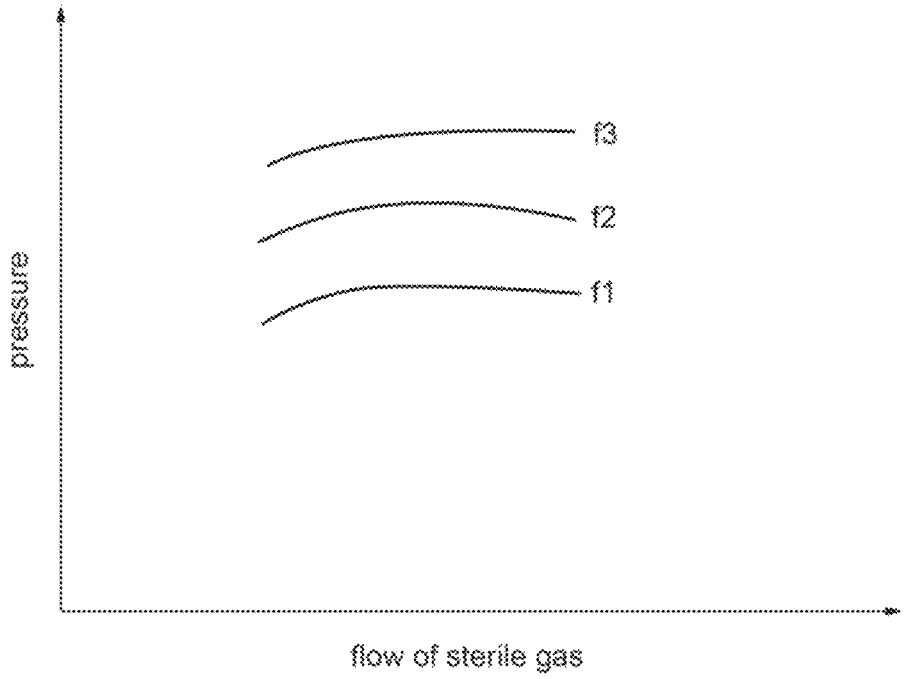
FIG. 3 shows characteristic operational curves of a component of the packaging apparatus of FIG. 1.

Preferentially, pressurizing means 43 are configured to allow for a variable flow of sterile gas (i.e. adapted to control varying flow rates) by maintaining a substantially constant gas pressure within second space 42 at the various flow rates (see FIG. 3).

In particular, pressurizing means 43 are configured to provide for a variable flow of sterile gas of about 10 to 200 $Nm^3/h$, in particular of 20 to 180 $Nm^3/h$, even more particular of about 25 to 150 $Nm^3/h$.

Preferentially, pressurizing means 43 are adapted to vary the flow of sterile gas in dependence of the sterile gas flowing from second space 42 to first space 43, in particular through at least fluidic channel 44. Such a configuration of pressurizing means 43 is advantageous as tube 3, in use, slightly fluctuates, meaning that the diameter (or equivalently the radius) slightly fluctuates in use, in particular due to minor variations in the extension of the overlap of longitudinal edges 19 and 20. This again results in fluctuations of the size of fluidic channel 44 and, consequently, of the amount of sterile gas flowing from second space 42 to first space 41 through fluidic channel 44.

In other words, in dependence of the amount of sterile gas passing from second space 42 to first space 41, in particular through fluidic channel 44, the pressurizing means 43 control the flow of sterile gas into second space 42 and, at the same time, maintain the pressure within second space 42 substantially constant.

In even other words, pressurizing means 43 must be configured such that a higher loss of sterile gas from second space 42 to first space 41 is compensated for by an increased flow of sterile gas into second space 42 and the substantial maintenance of a constant pressure within second space 42 (and consequently, a decreased loss of sterile gas from second space 42 to first space 41 is compensated for by a decreased flow of sterile gas into second space 42 by substantially maintaining a constant pressure within second space 42).

Preferentially, pressurizing means 43 are adapted to control the gas pressure within second space 42 to range between 5 kPa to 40 kPa (0.05 bar to 0.40 bar), in particular between 10 kPa to 30 kPa (0.1 bar to 0.3 bar), above ambient pressure.

Advantageously, pressurizing means 43 are designed such to provide for a closed sterile gas circuit from inner environment 11 into second space 42 and back into inner environment 11. This allows a simplified overall construction of apparatus 1, in particular related to the control and the supply of the sterile gas.

In more detail, pressurizing means 43 are adapted to withdraw sterile gas from inner environment 11, to pressurize (to compress) the sterile gas and to direct the pressurized (compressed) sterile gas into second space 42.

Preferentially, pressurizing means 43 comprise:

- at least one pumping device 46 adapted to withdraw sterile gas from inner environment 11, to pressurize (to compress) the sterile gas and to direct the pressurized sterile gas into second space 42; and
- at least one control unit 47 adapted to control operation of pumping device 46.

Preferentially, pumping device 46 is a rotary machine, even more particular a compressor.

Preferably, the rotary machine, in particular the compressor is configured to operate at high rotation speeds. More specifically, the rotary machine, in particular the compressor is configured to operate at rotation speeds ranging between 10000 to 100000 rpm, in particular 20000 to 80000 rpm, even more particular 30000 to 60000 rpm.

In more detail, control unit 47 is adapted to control the operating parameters of pumping device 46, in particular the rotary machine, even more particular the compressor as a function of at least one of the advancement speed of web 4 or the advancement speed of tube 3 (both advancement speeds are equal) or the format or the shape of packages 2 to be formed or the volume of packages 2 to be formed.

In the specific example disclosed, control unit 47 is adapted to control the rotation speed of the rotary machine, in particular of the compressor as a function of at least one of the advancement speed of web 4 or the advancement speed of tube 3 or the format of packages 2 to be formed or the volume of packages 2 to be formed.

Preferably and with particular reference to FIG. 3, the rotary machine, in particular the compressor is configured such that the pressure provided increases with increasing rotation speed.

FIG. 3 illustrates three example "pressure-flow of sterile gas"-curves at three different rotation speeds indicated as f1, f2 and f3 with f1 being smaller than f2 and f2 being smaller than f3.

Preferably, the rotary machine, in particular the compressor is configured to allow for a variable flow of sterile gas by maintaining a substantially constant gas pressure within second space 42, in particular as a function of the flow of gas from second space 42 to first space 41 (through fluidic channel 44).

The three exemplary "pressure-flow of sterile gas"-curves of FIG. 3 indicate that the curves have a substantially flat profile. This means that a change in the flow of sterile gas has substantially no influence on the pressure provided for by the rotary machine, in particular the compressor.

Preferably, pressurizing means 43 comprise a gas feeding pipe 48 being at least indirectly fluidically connected with inner environment 11 and second space 42 for directing the sterile gas from inner environment 11 into second space 42. In particular, gas feeding pipe 48 is directly fluidically connected with second space 42. Preferentially, gas feeding pipe 48 is at least indirectly connected with pumping device 46, in particular the rotary machine, even more particular the compressor.

In more detail, gas feeding pipe 48 comprises at least a main portion 49, which, in use, extends within tube 3. In particular, main portion 49 extends parallel to main pipe portion 28.

Even more particular, at least main portion 49 and main pipe portion 28 are coaxial to one another.

In the specific example shown, filling pipe 27 extends at least partially within gas feeding pipe 48. Alternatively, gas feeding pipe 48 could at least partially extend within filling pipe 27.

In more detail, at least main pipe portion 28 extends at least partially within main portion 49.

In particular, the cross-sectional diameter of main pipe portion 28 is smaller than the cross-section diameter of main portion 49.

Preferentially, gas feeding pipe 48 and filling pipe 27 define/delimit an annular conduit 50 for the sterile gas to be fed into second space 42. In particular, annular conduit 50 is delimited by the inner surface of gas feeding pipe 48 and the outer surface of filling pipe 27.

In other words, in use, the sterile gas is directed into second space 42 through annular conduit 50.

Pressurizing means 43 also comprise:

- a gas conduit 51 being in direct fluidic connection with pumping device 46, in particular the rotary machine, even more particular the compressor and the gas feeding pipe 48; and
- a gas conduit 52 being in direct fluidic connection with inner environment 11 and pumping device 46, in particular the rotary machine, even more particular the compressor.

Thus, in use, sterile gas is withdrawn from inner environment 11 through gas conduit 52, is then pressurized (compressed) by pumping device 46, in particular the rotary machine, even more particular the compressor, and is then directed into second space 42 through gas conduit 51 and gas feeding pipe 48.

Preferentially, delimiting element 40 is removably connected to at least a portion of filling pipe 27 and/or gas feeding pipe 48. In particular, delimiting element 40 is connected to at least a portion of filling pipe 27 and/or gas feeding pipe 48 in a floating manner (i.e. with play). In particular, in a floating manner means that delimiting element 40 is adapted to (slightly) move parallel to at least axis M (and to axis L). In other words, delimiting element 40 is adapted to (slightly) move parallel to the, in use, advancing tube 3.

In the specific case shown in FIGS. 1 and 2, delimiting element 40 is removably connected to gas feeding pipe 48.

In use, packaging apparatus 1 forms packages 2 filled with a pourable product. In particular, packaging apparatus 1 forms packages 2 from tube 3 formed from web 4, tube 3 being continuously filled with the pourable product.

In more detail, operation of packaging apparatus 1 comprises:

- a first advancement phase for advancing web 4 along path P;
- a tube forming and sealing phase during which web 4 is formed into tube 3 and tube 3 is longitudinally sealed, in particular along seam portion 23;
- a second advancement phase during which tube 3 is advanced along path Q;
- a filling phase during which the pourable product is continuously filled into tube 3; and
- a package forming phase during which packages 2 are formed from tube 3, in particular by shaping (respective (lower) portions) of tube 3 and transversally sealing and cutting tube 3.

In further detail, the tube forming and sealing phase comprises the phase of gradually overlapping edges 19 and 20 with one another for forming seam portion 23 and the phase of longitudinally sealing tube 3, in particular seam portion 23.

The filling phase comprises the phase of directing the pourable product through filling pipe 27 into second space 42.

During the package forming phase packages 2 are formed by operation of package forming unit 16, which receives tube 3 after the tube forming and sealing phase. In particular, during the package forming phase operative assemblies 31 and counter-operative assemblies 32 are advanced along their respective conveying paths. When operative assemblies 31 and their respective counter-operative assemblies 32 advance along their respective operative portions, operative assemblies 31 and the respective counter-operative assemblies 32 cooperate with one another for shaping, transversally sealing and transversally cutting advancing tube 3 so as to form packages 2. During the package forming phase, the pourable product is continuously directed into second space 42 so as to obtain filled packages 2.

Operation of packaging apparatus 1 also comprises a pressurizing phase during which sterile gas, in particular the pressurized (compressed) sterile gas is directed, in particular continuously directed, into second space 42.

In more detail, during the pressurizing phase sterile gas is withdrawn from isolation chamber 10, in particular from inner environment 11, the sterile gas is pressurized (compressed) and then directed, in particular continuously directed, into second space 42. The sterile gas is directed, in particular continuously directed, into second space 42 for obtaining a gas pressure within second space 42 which ranges between 5 kPa to 40 kPa (0.05 bar to 0.4 bar), in particular between 10 kPa to 30 kPa (0.1 bar to 0.3 bar), above ambient pressure.

In particular, second space 42 contains the pourable product and the pressurized sterile gas.

In even further detail, during the pressurizing phase pumping device 46, in particular the rotary machine, even more particular the compressor, withdraws the sterile gas from isolation chamber 10, in particular from inner environment 11, pressurizes (compresses) the sterile gas and directs the pressurized (compressed) gas through gas feeding pipe 43 into second space 42.

Furthermore, during the pressurizing phase a leakage flow of sterile gas is established from second space 42 to first space 41. In particular, sterile gas flows from second space 42 to first space 41 through fluidic channel 44.

During the pressurizing phase the operating parameters of pumping device 46 are controlled by control unit 47 in function of at least one of the advancement speed of web 4 or the advancement speed of tube 3 or the format or the shape of the packages to be formed or the volume of the packages to be formed.

In more detail, control unit 47 controls the rotation speed of the rotary machine, in particular the compressor, as a function of at least one of the advancement speed of the web of packaging material or the advancement speed of the tube or the format or the shape of the packages to be formed or the volume of the packages to be formed.

The advantages of packaging apparatus 1 according to the present invention will be clear from the foregoing description.

In particular, delimiting element 40 allows to obtain a high-pressure second space 42 and a low-pressure first space 41. The pressurized sterile gas within second space 42 replaces the action of the pourable product column for obtaining the required hydrostatic pressure for correctly forming packages 2. This allows to reduce the extension, in particular the vertical extension of isolation chamber 10.

Additionally, as the hydrostatic pressure is obtained by the sterile gas and not by the pourable product column, the modification work needed to be applied to packaging apparatus 1 in case of a format change or in case of a change in the production speed are minimal and require significant less time than with respect to apparatuses in which the hydrostatic pressure is obtained by means of the pourable product column.

A further advantage resides in that due to the leakage flow of sterile gas from second space 42 to first space 41 the gas pressure within second space 42 can be accurately controlled. In particular, the leakage flow of sterile gas from second space 42 to first space 41 allows to reduce the risk of the evolution of steep gradients in pressure over time.

An even other advantage lies in providing for a design of delimiting element 40 such that fluidic channel 44 is provided by a gap between the inner surface of tube 3 and delimiting element 40. Thus, there is no contact between delimiting element 40 and the inner surface of tube 3. Therefore, delimiting element 40 does not damage the inner surface of tube 3. As well, the risk of debris particles entering package 2 is significantly limited. An even further advantage resides in the fact that the sterile gas directed into second space 42 is taken from inner environment 11. Thus, no additional sterile gas sources are required, simplifying the design of apparatus 1 and the control of the sterile gas flows.

Clearly, changes may be made to packaging apparatus 1 as described herein without, however, departing from the scope of protection as defined in the accompanying claims.

In an alternative embodiment not shown, the filling pipe and the gas feeding pipe could be arranged spaced apart from and parallel to one another.

In a further alternative embodiment not shown, the delimiting element could be designed to abut, in use, against the inner surface of tube 3 and the delimiting element could be provided with an aperture or apertures for allowing for the at least one fluidic channel fluidically connecting the second space with the first space.

The invention claimed is:

1. A packaging apparatus for forming a plurality of sealed packages filled with a pourable product comprising:

conveying means adapted to advance a web of packaging material along an advancement path (P);

an isolation chamber separating an inner environment containing a sterile gas from an outer environment;

a tube forming device being at least partially arranged within the isolation chamber and being adapted to form and longitudinally seal a tube from the, in use, advancing web of packaging material; wherein the conveying means are also adapted to advance the tube along a tube advancement path (Q);

a delimiting element arranged, in use, within the tube and designed to divide the tube in a first space being in fluidic connection with the inner environment and a second space being arranged downstream of the first space along the tube advancement path (Q), wherein the delimiting element is designed to provide, in use, at least one fluidic channel for fluidically connecting the second space with the first space and for allowing, in use, a leakage flow of sterile gas from the second space into the first space;

filling means adapted to direct, in use, a pourable product into the second space;

pressurizing means adapted to direct, in use, a flow of sterile gas into the second space for obtaining a gas pressure within the second space that is higher than a gas pressure within the first space;

a package forming unit adapted to form and transversally seal the packages from the, in use, advancing tube;

wherein the pressurizing means are fluidically connected to the inner environment of the isolation chamber and are adapted to direct, in use, at least a portion of the sterile gas present in the inner environment into the second space of the tube.

2. The packaging apparatus according to claim 1, wherein the fluidic channel has an annular shape.

3. The packaging apparatus according to claim 1, wherein, in use, the fluidic channel is delimited by a peripheral portion of the delimiting element and the inner surface of the, in use, advancing tube.

4. The packaging apparatus according to claim 1, wherein the pressurizing means are adapted to allow for a variable flow of sterile gas by maintaining a substantially constant gas pressure within the second space.

5. The packaging apparatus according to claim 1, wherein the pressurizing means are adapted to control the gas pressure within the second space (42) to range between 5 kPa to 40 kPa above ambient pressure.

6. The packaging apparatus according to claim 1, wherein the pressurizing means comprise:

at least one pumping device; and at least one control unit adapted to control the operating parameters of the pumping device as a function of at least one of the advancement speed of the web of packaging material or the advancement speed of the tube or the format or the shape of the packages to be formed or the volume of the packages to be formed.

7. The packaging apparatus according to claim 6, wherein the pumping device is a rotary machine, in particular a compressor, and the control unit is adapted to control the rotation speed of the rotary machine as a function of at least the advancement speed of the web of packaging material or the advancement speed of the tube or the format or the shape of the packages to be formed or the volume of the packages to be formed.

8. The packaging apparatus according to claim 7, wherein the rotary machine is configured to operate at rotation speeds ranging between 10000 to 100000 rpm.

9. The packaging apparatus according to claim 8, wherein the rotary machine is a compressor.

10. The packaging apparatus according to claim 7, wherein the rotary machine is configured to operate at rotation speeds ranging between 30000 to 60000 rpm.

11. The packaging apparatus according to claim 1, wherein the filling means comprise at last a filling pipe, in use, at least partially extending within the tube and being adapted to direct, in use, the pourable product into the second space of the tube; and the pressurizing means comprise a gas feeding pipe being at least indirectly fluidically connected with the inner environment and the second space for directing the sterile gas from the inner environment into the second space.

12. The packaging apparatus according to claim 11, wherein at least a portion of the gas feeding pipe and at least a portion of the filling pipe are coaxially arranged to one another.

13. The packaging apparatus according to claim 12, wherein the gas feeding pipe and the filling pipe define an annular conduit for the sterile gas to be fed into the second space.

14. The packaging apparatus according to claim 11, wherein the delimiting element is connected to at least a portion of the filling pipe and/or the gas feeding tube.

15. The packaging apparatus according to claim 1, wherein the delimiting element is adapted to move along a direction parallel to the, in use, advancing tube.

16. The packaging apparatus according to claim 1 further comprising a sterilizing unit adapted to sterilize the web of packaging material.

17. The packaging apparatus according to claim 1, wherein the pressurizing means are adapted to control the gas pressure within the second space to range between 10 kPa to 30 kPa above ambient pressure.

* * * * *